US008425698B2

(12) United States Patent
Zhao et al.

(10) Patent No.: US 8,425,698 B2
(45) Date of Patent: Apr. 23, 2013

(54) ALUMINUM ALLOY SHEET AND METHOD FOR MANUFACTURING THE SAME

(75) Inventors: Pizhi Zhao, Shizuoka (JP); Toshiya Anami, Shizuoka (JP); Ichiro Okamoto, Shizuoka (JP); Hitoshi Kazama, Wako (JP); Kunihiro Yasunaga, Wako (JP); Noboru Hayashi, Wako (JP); Kevin Gatenby, Kingston (CA); Mark Gallerneault, Kingston (CA); Simon Barker, Kingston (CA)

(73) Assignees: Nippon Light Metal Co., Ltd, Shinagawa-Ku, Tokyo (JP); Novelis Inc., Toronto, Ontario (CA); Honda Motor Co., Ltd., Minato-Ku, Tokyo (JP)

( * ) Notice: Subject to any disclaimer, the term of this patent is extended or adjusted under 35 U.S.C. 154(b) by 32 days.

(21) Appl. No.: 11/572,832

(22) PCT Filed: Jul. 30, 2004

(86) PCT No.: PCT/JP2004/011323

§ 371 (c)(1),
(2), (4) Date: Sep. 15, 2008

(87) PCT Pub. No.: WO2006/011242

PCT Pub. Date: Feb. 2, 2006

(65) Prior Publication Data

US 2009/0007994 A1 Jan. 8, 2009

(51) Int. Cl.
*C22F 1/047* (2006.01)

(52) U.S. Cl.
USPC ..... 148/551; 148/695

(58) Field of Classification Search ..... 148/551, 148/695, 696
See application file for complete search history.

(56) References Cited

U.S. PATENT DOCUMENTS

| | | | | |
|---|---|---|---|---|
| 6,387,198 | B1 * | 5/2002 | Suzuki et al. | 148/692 |
| 6,592,688 | B2 | 7/2003 | Jin et al. | |
| 2002/0153069 | A1 * | 10/2002 | Jin et al. | 148/551 |
| 2004/0094245 | A1 | 5/2004 | Li et al. | |
| 2006/0042727 | A1 * | 3/2006 | Li et al. | 148/551 |

FOREIGN PATENT DOCUMENTS

| | | |
|---|---|---|
| EP | 069042 A1 | 1/1996 |
| JP | 04318145 | 11/1992 |
| JP | 06235039 | 8/1994 |
| JP | 07305134 | 11/1995 |
| JP | A 08-053732 | 2/1996 |
| JP | A 11-181558 | 7/1999 |
| JP | A2001-262263 | 9/2001 |
| JP | A2001-295007 | 10/2001 |
| JP | 2005002383 | 1/2005 |
| WO | WO02/11922 A2 | 2/2002 |

OTHER PUBLICATIONS

"Effect of Thermomechanical Treatment on the Evolution of Rolling and Recystallization Textures in Twin-Belt Cast AA5754 Aluminum Alloy" HN Azari, et al. Metallurgical and Materials Transactions; Jun. 2004; 35A p. 1839-1851.*

"International Alloy Designations and Chemical Composition Limits for Wrought Aluminum and Wrought Aluminum Alloys", The Aluminum Association, Apr. 2004, p. 7, 13.*

"Effect of Thermomechanical Treatment on the Evolution of Rolling and Recrystallization Textures in Twin-Belt Cast AA5754 Aluminum Alloy," H.N. Azari, S.X. Girard, D.S. Wilkinson and D.J. Lloyd, Metallurgical and Materials Transactions A, vol. 35A, Jun. 2004, pp. 1839-1851.

"The Mechanical and Metallurgical Characteristics of Twin-Belt Cast Aluminum Strip Using Current Hazelett Technology," W. Szczypiorski, R. Szczypiorski, Light Metals 1991, pp. 805-814.

* cited by examiner

*Primary Examiner* — Roy King
*Assistant Examiner* — Janelle Morillo
(74) *Attorney, Agent, or Firm* — Heslin Rothenberg Farley & Mesiti, P.C.

(57) ABSTRACT

An aluminum alloy sheet having excellent press formability and stress corrosion cracking resistance, comprises 3.3 to 3.6 percent by weight of Mg and 0.1 to 0.2 percent by weight of Mn, furthermore, 0.05 to 0.3 percent by weight of Fe and 0.05 to 0.15 percent by weight of Si, and the remainder comprises Al and incidental impurities, wherein the sizes of intermetallic compounds is 5 μm or less, the recrystallized grain size is 15 μm or less in the region at a depth of 10 to 30 μm below the sheet surface, and the surface roughness is Ra 0.2 to 0.7 μm.

2 Claims, No Drawings

ALUMINUM ALLOY SHEET AND METHOD FOR MANUFACTURING THE SAME

CROSS REFERENCE TO RELATED APPLICATIONS

This application is a 371 national stage filing of PCT International Application No. PCT/JP2004/011323, filed on Jul. 30, 2004, and published in English on Feb. 2, 2006, as WO 2006/011242 A1, the entire disclosure of which is incorporated herein by reference.

TECHNICAL FIELD

The present invention relates to an aluminum alloy sheet and a method for manufacturing the same, and in particular, it relates to an aluminum alloy sheet which is a forming material suitable for automobile body sheets and the like.

BACKGROUND ART

Body panels of automobiles, for example, have been primarily made from cold-rolled steel sheets until now. However, in accordance with the requirements for the weight reduction of automobile bodies, the use of aluminum alloy sheets of Al—Mg base, Al—Mg—Si base, and the like has been studied recently.

Generally known methods for manufacturing these aluminum alloy sheets includes a method in which a slab is cast by a DC casting method (semi-continuous casting), the slab is subjected to scalping and the resulting slab is inserted into a batch type furnace and is subjected to a homogenization treatment (soaking) for a few hours to about ten hours, followed by a hot rolling step, a cold rolling step, and an annealing step, so that a sheet having a predetermined thickness is completed (refer to, for example, JPP3155678).

Furthermore, a twin belt casting method is known in which a pair of parallel-opposed rotating endless belts are disposed, a melt of aluminum alloy is introduced into the gap between these endless belts, and is continuously taken out while being cooled, followed by being rewound around a coil (refer to, for example, PCT WO 2002/011922 (JP2004-505774A)).

However, with respect to the above-described DC casting method, since the cooling rate of the melt during casting is a relatively low one to about ten degrees centigrade per second, intermetallic compounds, e.g., Al—(Fe•Mn)—Si, crystallized in the matrix may grow to have size of ten to several tens of micrometers, particularly in the central portion of the slab. Such a intermetallic compound may adversely affect the press formability of a final annealed sheet prepared through a rolling and annealing step.

That is, when the final annealed sheet is deformed, if the size of the intermetallic compounds is relatively large, peeling (so-called void) tends to occur between the intermetallic compound and the matrix. Consequently, microcracks starting from this peeled portion may occur, so that the press formability may be deteriorated. Furthermore, dislocations accumulate around the intermetallic compound during cold rolling, and these dislocations serve nucleation sites for recrystallization during annealing. Therefore, if the intermetallic compounds become large, the number of intermetallic compounds per unit volume is decreased and, thereby, the concentration of nucleation sites for recrystallization grains is decreased. Consequently, the recrystallized grain size increases several tens of micrometers, and the press formability is deteriorated.

In the known method, a high Mg alloy is adopted to improve the press formability. However, if the content of Mg is increased, β phases precipitates in the shape of a film at grain boundaries as time goes by after the press forming is performed and, thereby, the stress corrosion cracking resistance is deteriorated.

In the known method, steps, e.g., scalping of the slab surface after the DC casting, a homogenization treatment, hot rolling, cold rolling, and intermediate annealing, are complicated and, therefore, the cost is increased.

On the other hand, in the belt casting method, the slab prepared by continuous casting of a melt is subjected to cold rolling and, therefore, there are advantages in that the steps are simplified compared with those in the DC casting method, and the manufacturing cost can be reduced.

However, in this belt casting method as well, no study has been conducted with respect to the improvement of quality, e.g., the press formability and the stress corrosion cracking resistance of the final annealed sheet.

DISCLOSURE OF INVENTION

It is an object of the present invention to manufacture an aluminum alloy sheet having excellent press formability and stress corrosion cracking resistance by the belt casting method.

In order to overcome the above-described problems, an aluminum alloy slab ingot used in the present invention is prepared by casting a melt containing 3.3 to 3.6 percent by weight of Mg and 0.1 to 0.2 percent by weight of Mn, furthermore, 0.05 to 0.3 percent by weight of Fe and 0.05 to 0.15 percent by weight of Si, and the remainder comprised of Al and incidental impurities into a slab of 5 to 15 mm in thickness with a twin belt type caster in order that the region of one quarter-thickness below the surface is cooled at a cooling rate of 20° C./sec to 200° C./sec.

The resulting aluminum alloy slab ingot is directly rewinded around a roll, the slab ingot is cold-rolled with a rolling roll having a surface roughness of Ra 0.2 to 0.8 μm and, thereafter, annealing is performed in order that the size of intermetallic compounds becomes 5 μm or less, the recrystallized grain size becomes 15 μm or less in the region at a depth of 10 to 30 μm below the sheet surface of the final annealed sheet, and the surface roughness becomes Ra 0.2 to 0.7 μm. Consequently, an aluminum alloy sheet having excellent press formability and stress corrosion cracking resistance can be prepared.

BEST MODE FOR CARRYING OUT THE INVENTION

The description will be made below with reference to the embodiment of the present invention. According to the present embodiment, a melt is introduced into a twin belt type caster, a slab is continuously cast, and the resulting slab is rewinded around a roll. With respect to the twin belt type caster, for example, a pair of parallel-opposed rotating endless belts are disposed, the melt is introduced into a flat portion sandwiched between the belts, and is transferred in accordance with the rotation of the belts, so that the melt is cooled and, thereby, a slab having a predetermined sheet thickness is cast continuously.

The slab cast with the twin belt type caster has a total thickness of, for example, 5 to 15 mm, and a region of one quarter-thickness below the surface relative to the total slab thickness is cooled at a cooling rate of 20° C./sec to 200° C./sec during the casting. Consequently, the size of intermetallic compounds of Al—(Fe•Mn)—Si base and the like becomes a very fine 5 μm or less in the region at a depth of 10 to 30 μm below the sheet surface of the final annealed sheet. Therefore, even when the final annealed sheet is deformed, peeling between the intermetallic compounds and the matrix is difficult to occur, and press formability is excellent compared with those of a DC casting rolled sheet in which microcracks starting from the peeled portion occur.

Furthermore, dislocations accumulate around the intermetallic compounds during cold rolling, and these dislocations serve as nucleation sites for recrystallization. In the case of a cold-rolled sheet of a slab in which the size of intermetallic compounds is relatively small, the number of intermetallic compounds per unit volume is increased and, thereby, the concentration of nucleation sites for recrystallization is increased. Consequently, the recrystallized grain size becomes relatively small 15 μm or less, and a final annealed sheet having excellent press formability can be produced.

In addition to the above-described relatively simplified manufacturing steps, when a cold roll used in the cold rolling of the slab is polished with a grinder and the like, the surface roughness of the roll is controlled at within the range of Ra 0.2 to 0.8 μm in the present embodiment. The shape of the rolling-roll surface is transferred to the rolled sheet surface during the cold-rolling step and, thereby, the surface roughness of the final annealed sheet becomes Ra 0.2 μm to 0.7 μm. When the surface roughness of the final annealed sheet is within the range of Ra 0.2 to 0.7 μm, the surface shape of the final annealed sheet serves the function as micropools to uniformly hold low-viscosity lubricant used during the forming and, thereby, a predetermined press formability can be ensured.

The significance and the reasons for the limitations of the alloy components in the present embodiment, and the reasons for the limitation of the size of intermetallic compounds and size of recrystallized grains generated in the final annealed sheet, the surface roughness of the final annealed sheet, the cooling rate during the casting of the slab, the surface roughness of the cold-rolling roll, and the like will be described below.

When Mg is allowed to present in the matrix as a solid solution, the strength of the final annealed sheet is increased and, in addition, the work hardenability is enhanced to increase the ductility, so that an improvement of the press formability is accelerated. The amount of addition is specified as being 3.3 to 3.6 percent by weight because if less than 3.3 percent by weight, the strength is low and the formability is poor, and if more than 3.6 percent by weight, the stress corrosion cracking resistance (SCC resistance) is deteriorated and the manufacturing cost is increased.

With respect to Mn, recrystallized grains are allowed to become finer and, in addition, the strength is increased, and the press formability is improved. The amount of addition is specified as being 0.1 to 0.2 percent by weight because if less than 0.1 percent by weight, the effect thereof is not adequately exhibited, and if more than 0.2 percent by weight, intermetallic compounds of Al—(Fe•Mn)—Si base are increased and, thereby, the ductility of the material is decreased, so that the formability of an aluminum sheet for an automobile is deteriorated.

When Fe is allowed to coexist with Mn and Si, fine Al—(Fe•Mn)—Si based compounds are crystallized during the casting, recrystallized grains are allowed to become fine and, in addition, the strength is increased, so that the press formability is improved. If the amount of addition is less than 0.05 percent by weight, the effect thereof is not adequately exhibited, and if more than 0.3 percent by weight, the number of relatively coarse Al—(Fe•Mn)—Si based intermetallic compounds is increased during the casting so as to decrease the press formability and, in addition, the amount of solid solution of Mn in the slab is decreased, and the strength of the final annealed sheet is decreased. Therefore, the content of Fe is preferably within the range of 0.05 to 0.3 percent by weight, and more preferably is 0.05 to 0.2 percent by weight.

When Si is allowed to coexist with Fe and Mn, fine Al—(Fe•Mn)—Si based compounds are crystallized during the casting, recrystallized grains are allowed to become fine and, in addition, the strength is increased. If the amount of addition is less than 0.05 percent by weight, the effect thereof is not adequately exhibited, and if more than 0.15 percent by weight, the number of Al—(Fe•Mn)—Si based intermetallic compounds is increased during the casting so as to decrease the press formability and, in addition, the amount of solid solution of Mn in the slab is decreased, and the strength of the final annealed sheet is decreased. Therefore, the content of Si is preferably within the range of 0.05 to 0.15 percent by weight, and more preferably is 0.05 to 0.10 percent by weight.

Preferably, the size of intermetallic compounds in the region at a depth of 10 to 30 μm below the sheet surface of the final annealed sheet is 5 μm or less. In the case where the final annealed sheet is deformed, when the size of the intermetallic compounds is 5 μm or less, peeling is difficult to occur between the intermetallic compounds and the matrix, occurrence of microcracks starting from the peeled portion is suppressed, and the press formability are improved. When the size of the intermetallic compounds is 5 μm or less, the number of intermetallic compounds per unit volume is increased and, thereby, the concentration of nucleation sites for recrystallization is increased during the annealing. Consequently, the size of recrystallized grains becomes a relatively small 15 μm or less, and the effect of improving the press formability is exhibited.

Preferably, the size of recrystallized grains in the sheet surface layer of the final annealed sheet is 15 μm or less. If the size exceeds 15 μm not only formability is deteriorated, height differences generated at grain boundaries during deformation of the material become too large, orange peel after deformation becomes remarkable and, thereby, deterioration of the quality of the surface after the press forming is brought about.

Preferably, the surface roughness of the final annealed sheet is Ra 0.2 to 0.7 μm. If the surface roughness is less than Ra 0.2 μm, generation of micropools to hold low-viscosity lubricant used during the forming on the final annealed sheet becomes inadequate and, thereby, it becomes difficult to uniformly penetrate the lubricant into the interface between the sheet surface and the press dies, so that the press formability is not improved. On the other hand, if the surface roughness exceeds Ra 0.7 μm, micropools are sparsely and nonuniformly distributed on the final annealed sheet and, thereby, it becomes difficult to uniformly hold the lubricant on the sheet surface, so that the press formability is not improved. The surface roughness of the final annealed sheet is more preferably Ra 0.3 to 0.6 μm.

The alloy component may contain 0.10 percent by weight or less of grain refiner for cast slab (for example, Ti). Furthermore, the alloy component may contain Cu, V, Zr, and the like as impurities at a content within the range of 0.05 percent by weight or less each.

The significance and the reasons for the limitations of the condition of casting of the slab will be described below. The thickness of the slab prepared with a twin belt type caster is specified as being within the range of 5 to 15 mm because if the thickness is less than 5 mm, the amount of melt passing through the caster on a unit time basis is small and, therefore, it becomes difficult to perform the casting, and if the thickness exceeds 15 mm, rewinding with a roll becomes impossible.

With respect to the slab prepared by DC casting, the slab has a large thickness, and in the metal structure, intermetallic compounds, e.g., Al—(Fe•Mn)—Si, crystallized in the central portion of the slab may have size reaching ten to several tens of micrometers because the cooling rate is a relatively low one to ten-odd degrees centigrade per second. In this case, peeling may occur between the intermetallic compounds and the matrix during plastic deformation so as to adversely affect the press formability. On the other hand, with respect to the twin belt type caster of the present embodiment, the slab can be controlled to have a reduced thickness, the cooling rate of the region of one quarter-sheet thickness below the surface can be increased to 20° C./sec to 200° C./sec and, thereby, the size of intermetallic compounds in the region at a depth of 10 to 30 μm below the sheet surface of the final annealed sheet is allowed to become 5 μm or less.

With respect to the cold-rolling roll, the surface roughness of the roll surface is specified as being Ra 0.2 to 0.8 μm to control the surface roughness of the final annealed sheet. Since the shape of the roll surface is transferred to the rolled sheet surface during the cold rolling step, the surface roughness of the final annealed sheet becomes Ra 0.2 to 0.7 μm. When the surface roughness of the final annealed sheet is within the range of Ra 0.2 to 0.7 μm, the surface shape of the final annealed sheet serves the function as micropools to uniformly hold the low-viscosity lubricant used during the forming and, thereby, a sheet having excellent press formability can be provided. Since the surface roughness of the final annealed sheet is more preferably Ra 0.3 to 0.6 μm, the surface roughness of the cold rolling roll is more preferably specified as being Ra 0.3 to 0.7 μm.

As described above, according to the present embodiment, an aluminum alloy sheet having excellent press formability and stress corrosion cracking resistance, in particular, an aluminum alloy sheet suitable for the use in an automobile can be provided.

EXAMPLES

The examples according to the present invention will be described below in comparison with the comparative examples. A melt having a composition A shown in Table 1 (Example) was degassed and settled, and subsequently, a slab was cast by a twin belt caster. The resulting slab was cold-rolled into a sheet of 1 mm in thickness with a cold-rolling roll. The resulting sheet was continuously annealed (CAL) at 420° C. and, thereby, a test specimen of a final annealed sheet was prepared. Table 2 (Examples 1 to 3) shows an example of manufacturing condition of the test specimen in each manufacturing process.

TABLE 1

Table 1 Alloy composition (wt. %)

| | Alloy | Mg | Mn | Fe | Si |
|---|---|---|---|---|---|
| Example | A | 3.4 | 0.15 | 0.20 | 0.08 |
| Comparative example | B | 3.0 | 0.15 | 0.20 | 0.08 |
| Comparative example | C | 4.5 | 0.15 | 0.20 | 0.08 |

The remainder is composed of Al and incidental impurities.

TABLE 2

Table 2 Manufacturing process

| | Alloy | Casting method/ thickness (mm) | Cooling rate (° C./s) | Hot rolling | Cold-rolling roll surface roughness Ra(μm) | Sheet thickness (mm) | Annealing temperature (° C.) |
|---|---|---|---|---|---|---|---|
| Example 1 | A | Twin belt/7 | 75 | None | 0.6 | 1 | 420 |
| Example 2 | A | Twin belt/9 | 45 | None | 0.6 | 1 | 420 |
| Example 3 | A | Twin belt/5 | 100 | None | 0.6 | 1 | 420 |
| Comparative example 1 | B | Twin belt/7 | 75 | None | 0.6 | 1 | 420 |
| Comparative example 2 | C | Twin belt/7 | 75 | None | 0.6 | 1 | 420 |
| Comparative example 3 | A | Twin belt/7 | 75 | None | 0.2 | 1 | 420 |
| Comparative example 4 | A | Twin belt/7 | 75 | None | 1.0 | 1 | 420 |
| Comparative example 5 | A | DC/500 | 5 | 7 mm | 0.6 | 1 | 420 |
| Comparative example 6 | A | Twin roll/7 | 250 | None | 0.6 | 1 | 420 |

Subsequently, the recrystallization grain size, the maximum size of intermetallic compounds, the surface roughness, the 0.2 percent yield strength (0.2% YS), the ultimate tensile strength (UTS), the elongation (EL), the deep drawing height, and the stress corrosion cracking resistance (SCC resistance) life of the resulting test specimen were measured.

The recrystallization grain size of the test specimen was measured by a intercept method. A photograph (200 times) of grains in the test specimen was taken with an polarizing microscope, three lines are drawn in a vertical direction and in a horizontal direction each, the number of grains crossing a line is counted, and an average value of grain sizes determined by dividing the length of the line by the number was taken as the recrystallization grain size of the test specimen. The sizes of the intermetallic compounds were measured with an image analyzer (LUZEX).

The surface roughness of the test specimen was an average roughness Ra, wherein the measurement was performed with a surface roughness tester in accordance with JIS B0601, the measurement direction was a direction perpendicular to the rolling direction, the measurement region was 4 mm, and the cutoff was 0.8 mm. The surface roughness of roll was an average roughness Ra, wherein the measurement was performed with a surface roughness tester in accordance with JIS B0601, the measurement direction was a rolling transverse direction, the measurement region was 4 mm, and the cutoff was 0.8 mm, as in the surface roughness of the test specimen.

The deep drawing height indicates a critical height of forming at breakage while the following die is used. Punch: 40 mm in diameter, shoulder R: 8 mm, die: 42.5 mm in diameter, shoulder R: 8 mm With respect to the evaluation of the SCC resistance, the final annealed sheet was cold-rolled at a cold-rolling reduction of 30 percent, and a sensitization treatment was performed at 120° C. for 1 week. Thereafter, stress corresponding to 85 percent of the yield strength was applied, immersion in 3.5 percent salt water was performed continuously, and the time elapsed until crack occurred was measured and taken as the SCC resistance life.

The results of the above-described measurement are shown in Table 3 (Examples 1 to 3).

TABLE 3

Microstructure and properties of test specimen (final annealed sheet)

| | Alloy | Recrystallized grain size (μm) | Maximum size of intermetallic compounds (μm) | Surface roughness Ra (μm) | 0.2% YS (MPa) | UTS (MPa) | EL (%) | Deep drawing height (mm) | SCC resistance life (day) |
|---|---|---|---|---|---|---|---|---|---|
| Example 1 | A | 8 | 4 | 0.45 | 118 | 240 | 28 | 13.2 | >30 days |
| Example 2 | A | 10 | 5 | 0.44 | 116 | 238 | 27 | 13.0 | >30 days |
| Example 3 | A | 7 | 3 | 0.42 | 121 | 243 | 30 | 13.4 | >30 days |
| Comparative example 1 | B | 9 | 5 | 0.43 | 107 | 220 | 25 | 12.4 | >30 days |
| Comparative example 2 | C | 7 | 4 | 0.44 | 130 | 280 | 30 | 13.6 | 1 day |
| Comparative example 3 | A | 8 | 4 | 0.1 | 119 | 242 | 28 | 12.1 | >30 days |
| Comparative example 4 | A | 8 | 4 | 0.8 | 120 | 243 | 29 | 12.5 | >30 days |
| Comparative example 5 | A | 22 | 15 | 0.45 | 105 | 235 | 28 | 12.4 | >30 days |
| Comparative example 6 | A | 54 | 2 | 0.35 | 100 | 223 | 27 | 12.3 | >30 days |

Test specimens were prepared from melts having compositions shown in Table 1 under the manufacturing conditions shown in Table 2 (Comparative examples 1 to 6). The prepared test specimens were evaluated by performing measurements with respect to the same items as those in Examples 1 to 3, and the measurement results are shown in Table 3 (Comparative examples 1 to 6).

With respect to Examples 1 to 3, the Mg content is an appropriate 3.4 percent, specimen includes fine recrystallized grains and intermetallic compounds, the surface has an appropriate surface roughness of Ra 0.42 to 0.45 μm and, therefore, excellent deep drawability and excellent SCC resistance are exhibited.

That is, With respect to Examples 1 to 3, a melt is introduced into a twin belt type caster, a slab is continuously cast, and resulting slab is rewinded around a roll. The cooling is performed during the casting in order that the region of at least one quarter-thickness below the surface relative to the slab thickness is cooled at a cooling rate of 20° C./sec to 200° C./sec. In this manner, with respect to the microstructure in the region at a depth of 10 to 30 μm below the sheet surface of the final annealed sheet, Al—(Fe•Mn)—Si based intermetallic compounds and the like are allowed to become very fine 5 μm or less. Consequently, peeling between the intermetallic compounds and the matrix is difficult to occur even when the final annealed sheet is deformed, and a sheet having excellent press formability can be produced.

Since the sizes of intermetallic compounds are relatively small and, in addition, the number per unit volume is increased, the concentration of nucleation sites for recrystallization grains is increased. As a result, the recrystallized grain size becomes a relatively small 15 μm or less and, thereby, a sheet having excellent press formability is provided.

Furthermore, the surface roughness of the final annealed sheet is allowed to become within the limited range of Ra 0.2 to 0.7 μm by controlling the surface roughness of the rolling roll at within the range of Ra 0.2 to 0.8 μm when the roll to be used in the cold rolling is polished with a grinder and, thereby, the surface shape of the final annealed sheet serves the function as micropools to uniformly hold the low-viscosity lubricant used during the forming, so that the press formability can be further improved.

On the other hand, in Comparative example 1, since the Mg content is a low 3.0 percent, all of the ultimate tensile strength, and the elongation are inadequate, and poor deep drawability is exhibited. In Comparative example 2, since the Mg content is a high 4.5 percent, all of the ultimate tensile strength, and the elongation are outstanding, but poor SCC resistance is exhibited.

In Comparative example 3, the surface roughness Ra is a low 0.1 μm and, therefore, the surface is smoother than the surfaces in Examples 1 to 3, but poor deep drawability is exhibited. In Comparative example 4, the surface roughness Ra is a high 0.8 μm and, therefore, the surface is rougher than the surfaces in Examples 1 to 3, and poor deep drawability is exhibited in this case as well.

In Comparative example 5, a DC casting material is used. Since the cooling rate during the casting is relatively low, included recrystallized grains and intermetallic compounds are slightly coarser than those in Examples 1 to 3, and poor deep drawability is exhibited. In Comparative example 6, a twin roll casting material is used. Since the cooling rate during the casting is too high, intermetallic compounds are finer than those in Examples 1 to 3, recrystallized grains are coarse, and poor deep drawability is exhibited.

As described above, the resulting aluminum alloy slab cast by a twin belt caster is directly rewound around a roll, the slab is cold-rolled with a rolling roll having a surface roughness of Ra 0.2 to 0.8 μm and, thereafter, annealing is performed in order that the sizes of intermetallic compounds become 5 μm or less, the recrystallized grain size becomes 15 μm or less in the region at a depth of 10 to 30 μm below the sheet surface of the final annealed sheet, and the surface roughness becomes Ra 0.2 to 0.7 μm. Consequently, an aluminum alloy sheet having excellent press formability and stress corrosion cracking resistance can be prepared.

The invention claimed is:

1. A method for manufacturing an aluminum alloy sheet having excellent press formability and stress corrosion cracking resistance, comprising the steps of:

using a twin belt type caster, casting a melt consisting essentially of 3.3 to 3.6 percent by weight of Mg and 0.1 to 0.2 percent by weight of Mn, 0.05 to 0.2 percent by weight of Fe, 0.05 to 0.15 percent by weight of Si and 0.10 percent by weight or less of Ti, the balance being Al and incidental impurities, into a slab of 5 mm to 9 mm thickness, cooling the slab so that a region of one quarter-thickness below a surface of said slab is cooled at a cooling rate of 45° C./sec to 100° C./sec, without homogenizing or hot-rolling the resulting slab, winding the resulting slab around a roll, rewinding the slab from the roll, cold-rolling the slab rewound from the roll at a cold reduction rate of 80% to 88.9% with a rolling roll having a surface roughness of Ra 0.2 μm to 0.8 μm, without inter-annealing, thereby forming a sheet, and annealing the sheet, thereby producing intermetallic compounds having a size of 5 μm or less, and an average recrystallized grain size of 7 μm to 10 μm in a surface region of 10 μm to 30 μm depth, and a surface roughness of Ra 0.2 μm to 0.7 μm.

2. A method for manufacturing an aluminum alloy sheet having excellent press formability and stress corrosion cracking resistance, comprising the steps of:

using a twin belt type caster, casting a melt consisting essentially of 3.3 to 3.6 percent by weight of Mg and 0.1 to 0.2 percent by weight of Mn, 0.05 to 0.2 percent by weight of Fe, 0.05 to 0.15 percent by weight of Si and 0.10 percent by weight or less of Ti, the balance being Al and incidental impurities, into a slab of 5 mm to 9 mm thickness, cooling the slab so that a region of one quarter-thickness below a surface of said slab is cooled at a cooling rate of 45° C./sec to 100° C./sec, without homogenizing or hot-rolling the resulting slab, winding the resulting slab around a roll, rewinding the slab from the roll, cold-rolling the slab rewound from the roll at a cold reduction rate of 80% to 88.9% with a rolling roll having a surface roughness of Ra 0.2 μm to 0.8 μm, without inter-annealing, thereby forming a sheet, and annealing the sheet continuously by a continuous annealing line, thereby producing intermetallic compounds having a size of 5 μm or less, and an average recrystallized grain size of 7 μm to 10 μm in a surface region of 10 μm to 30 μm depth, and a surface roughness of Ra 0.2 μm to 0.7 μm.

* * * * *